US005110397A

United States Patent [19]

Fraser

[11] Patent Number: 5,110,397

[45] Date of Patent: May 5, 1992

[54] APPARATUS FOR MAKING PILE FABRICS

[75] Inventor: Neil S. Fraser, Elderslie, Great Britain

[73] Assignee: Stoddard Sekers International plc, Elderslie, Scotland

[21] Appl. No.: 409,128

[22] Filed: Sep. 19, 1989

[30] Foreign Application Priority Data

Sep. 20, 1988 [GB] United Kingdom ..... 8822050

[51] Int. Cl.[5] ..... D04H 11/08

[52] U.S. Cl. ..... 156/435; 156/72

[58] Field of Search ..... 156/72, 435

[56] References Cited

U.S. PATENT DOCUMENTS 3,943,027 3/1976 Wethington ..... 156/435

4,151,026 4/1979 Hospied ..... 156/435

4,363,694 12/1982 Fay ..... 156/435

*Primary Examiner*—Michael W. Ball

*Assistant Examiner*—Francis J. Lorin

*Attorney, Agent, or Firm*—Ratner & Prestia

[57] ABSTRACT

An apparatus for forming non-woven pile fabric comprises a pair of folding blades which oscillate to form ballows folds in warp threads passing between them. The folder blades are carried on forward ends of supports pivotally hung on pairs of suspension members. One suspension member of each pair is driven from a crank to impart oscillatory motion, while the other is adjustable in effective length to set the travel of the folder blade. Such length adjustment is effected by the upper ends of the suspension members being mounted on adjustable eccentric mountings.

7 Claims, 3 Drawing Sheets

APPARATUS FOR MAKING PILE FABRICS

This invention relates to apparatus for manufacturing non-woven pile fabrics, such as carpets or velvets.

It is known to manufacture fabrics by coating a layer of adhesive on one side only of two continuous support bands, the support bands then being displaced in a passage so that the bands are disposed substantially parallel to one another at a predetermined distance from one another with the adhesive layer on each of the support bands facing the adhesive layer on the other support band; a warp of continuous elements if moved by folder blades alternately against the adhesive layers on the support bands when the support bands are displaced at the entrance to the passage or in the neighbourhood thereof, to fold the warp into a zig-zag shape; at least one of the adhesive layers is then supported and the support bands are separated from one another.

U.S. Pat. No. 3,691,069, now U.S. Pat. No. 29,988, ("the prior patent") the contents of which are incorporated herein by reference describes an apparatus for carrying out this type of process, in which the folder blades are carried by a linkage which is so arranged that the folder blades fold the warp and impress it into the adhesive layers without slipping contact occurring between the folder blades and the warp. Each folder blade is carried on a support which is in turn pivotally suspended by pairs of cranks, at least one crank in each pair having an adjustable length. Adjustment of this length affects adjustment of the end position of the travel of the folder blade, as is necessary to adjust the correct impression of a given warp into a given adhesive layer on a given backing material. When any one or more of these is changed, the travel of the folder blades also requires to be changed.

In the apparatus of the prior patent this length adjustment is achieved by means of a turnbuckle in the crank. When producing carpet, the folder blades may be of considerable length, typically 18 feet, and each folder blade will require typically twelve pairs of crank. Thus, setting up and adjustment of the folder blade travel will require adjustment of twenty-four turnbuckles. This is awkward and time consuming, and there is a possibility of error in adjusting one or some of the turnbuckles producing uneven loading on the folder blades.

It is accordingly an object of the present invention to provide an apparatus in which the problems discussed above are overcome or mitigated.

To this end, the invention provides apparatus for manufacturing fabrics with non-woven pile, including means for moving a pair of continuous support bands along a passage with the bands disposed substantially parallel to a longitudinal axis of the passage and to each other and at a predetermined distance from each other, means for folding a warp at the entrance of the said passage comprising two folder blades arranged to move the said warp continuously and alternately in opposite directions to form a series of bellows folds between the support bands in the passage, supporting means for each folder blade, suspension means for each supporting means, and operating means for oscillatory driving of the supporting means; the suspension means for each folder blade comprising a plurality of pairs of cranks, each crank being pivotally connected at one end to a fixed part of the apparatus and pivotally connected at the other end to its respective supporting means; and in which at least one crank of each pair has said one end mounted to said fixed part via an eccentric mounting whereby the effective arc length of the crank can be varied in a stepless manner.

Preferably, means are provided for adjusting all the eccentric mountings for each folder blade simultaneously.

In a particularly preferred form of the invention, each folder blade has associated therewith a shaft extending parallel to the folder blade, the shaft being mounted for rotation in bearings secured to said fixed part; and each eccentric mounting comprises an eccentric bush rotatable with the shaft and presenting a cylindrical outer surface which is eccentric with respect to the shaft, said crank being secured to a ring member in bearing engagement with said eccentric bush outer surface. A cylindrical bearing bush may be interposed between the ring member and said eccentric bush outer surface. Means are provided for adjusting the rotational position of the shaft, suitably in the form of a handwheel driving the shaft via reduction gearing which may comprise a worm drive gearbox.

An embodiment of the invention will now be described, by way of example only, with reference to the drawings, in which.

Figure 1:
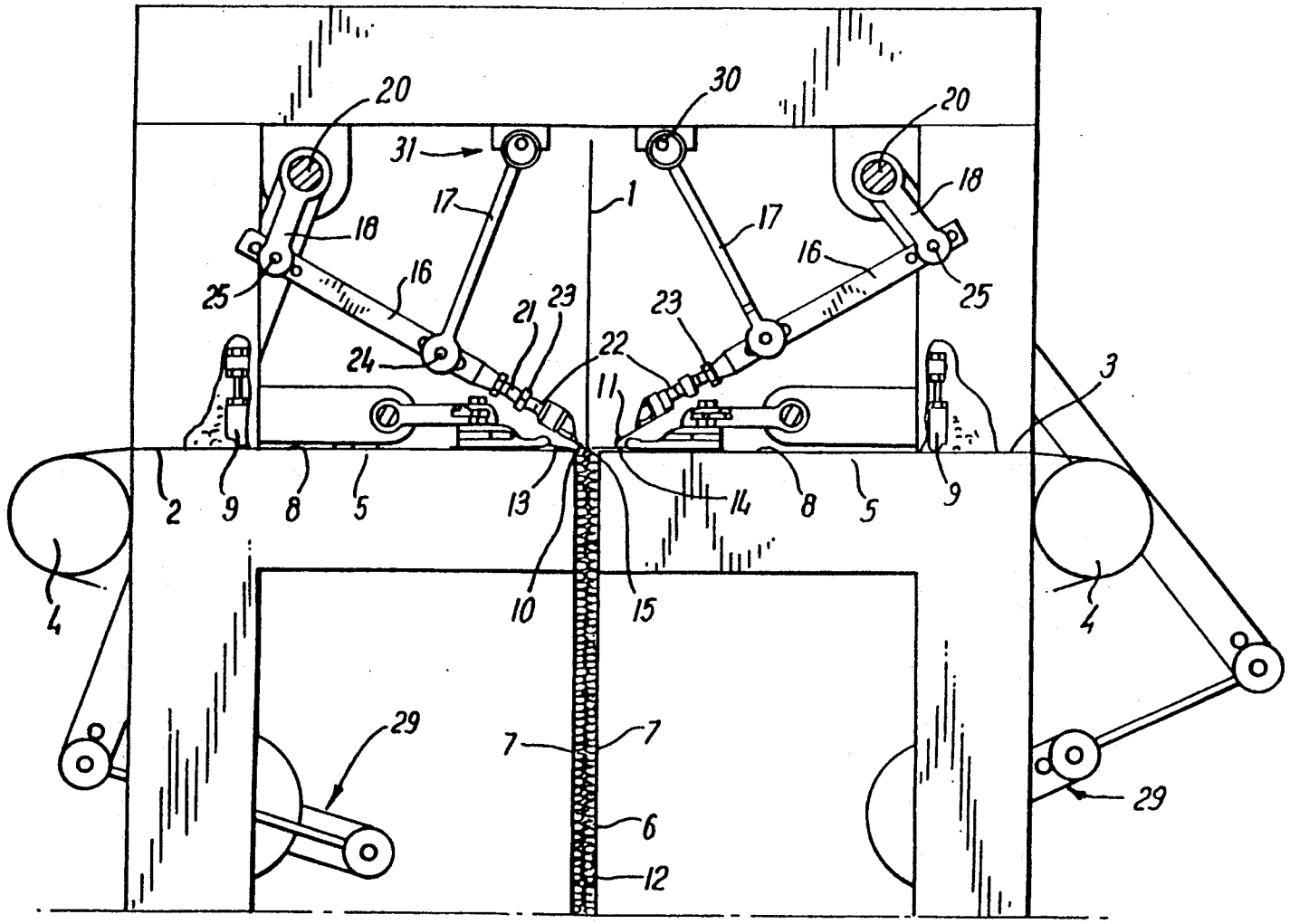
FIG. 1 is a schematic end elevation of an apparatus for producing non-woven carpets.

Referring to FIG. 1, the apparatus is generally similar to that described in the prior patent, and reference numerals 1–29 in FIG. 1 denote the same parts as in the prior patent, to which reference is made for a full description of the mode of operation. In the present invention, however, adjustment of the motion of the folder blades 10 and 11 is made by adjusting the effective length of the cranks 17 as will now be described.

Figure 2:
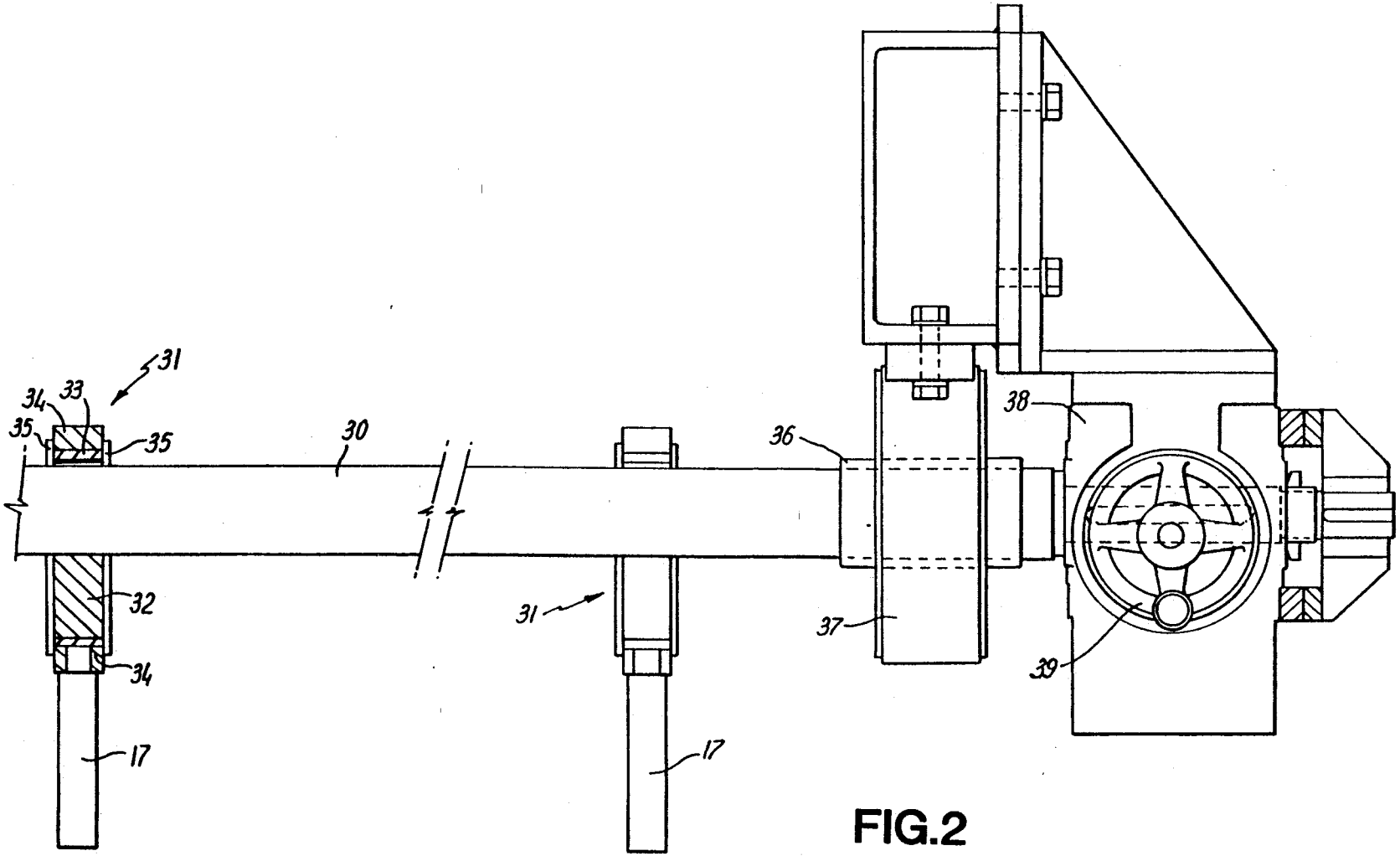
FIG. 2 is a detailed side view of an adjustment system forming part of the apparatus of FIG. 1.

Referring particularly to FIG. 2 the cranks 17 for one folder blade 10 or 11 are hung from a common shaft 30 via adjuster assemblies 31. The shaft 30 is rotatably mounted in spaced bearings 36 secured to brackets 37 on the machine frame. Each assembly 31 comprises an eccentric bush 32 keyed to the shaft 30 to rotate therewith, a cylindrical bearing bush 33, and a ring member 34 to which the crank 17 is secured; these parts are held in alignment by side plates 35 secured to the ring number 34 and in sliding contact with the bushes 32 and 33.

Figure 3A:
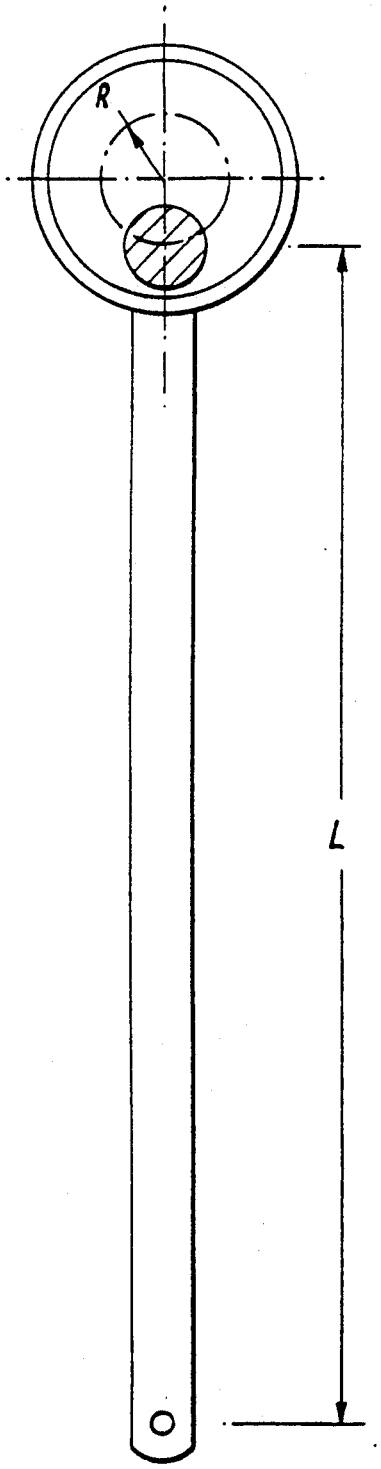
FIGS. 3A and 3B illustrate the operation of an adjuster assembly forming part of the apparatus.
Figure 3B:
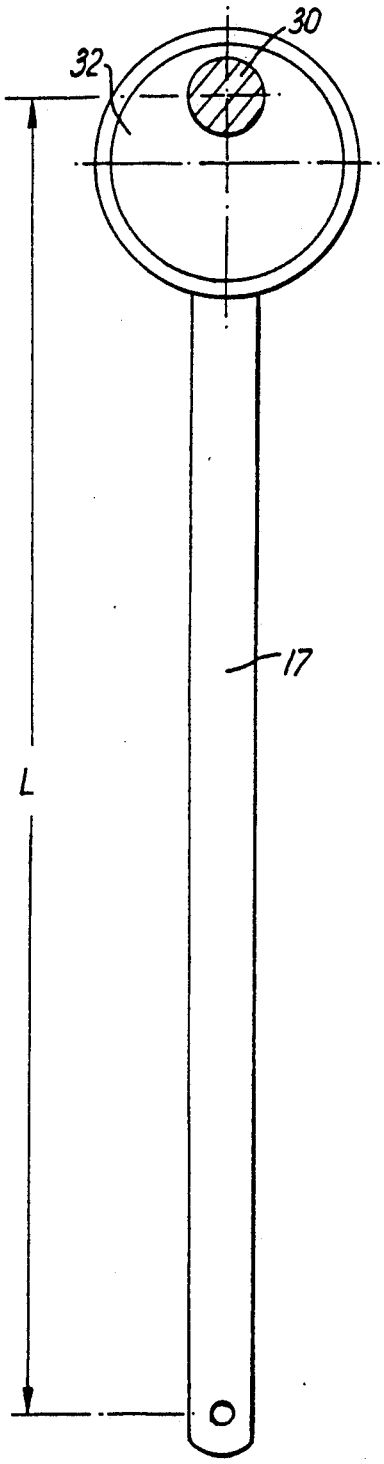

Secured to one end of the shaft 30 is a worm drive gearbox 38 manually operable by a handwheel 39. Thus by rotating the handwheel 39, the operator can accurately set the angular position of shaft 30 and correspondingly the angular positions of each of the eccentric bushes 32. It will be appreciated from FIG. 3A and 3B that the effective operating length L of the crank 17 is the distance from the centerline of shaft 30 to the pivot 24, and the rotation of shaft 30 varies L by a maximum of 2R, where R is the radial distance between the center of the eccentric bush 32 and the centre of the shaft 30.

Thus, adjustment of the end position of the arc of travel of the folder blades can be made in a simple and rapid manner.

All the cranks for one blade are adjusted simultaneously and equally. Fine adjustment can be carried out while the apparatus is in operation, which is not possible in the prior art apparatus.

I claim:

1. Apparatus for manufacturing fabrics with non-woven pile, including means for moving a pair of continuous support bands along a passage with the bands disposed substantially parallel to a longitudinal axis of the passage and to each other and at a predetermined distance from each other, means for folding a warp at the entrance of the said passage comprising two folder blades arranged to move the said warp continuously and alternately in opposite directions to form a series of bellows folds between the support bands in the passage, supporting means for each folder blade, suspension means for each supporting means, and operating means for oscillatory driving of the supporting means; the suspension means for each folder blade comprising a plurality of paris of cranks, each crank being pivotally connected at one end to a fixed part of the apparatus and pivotally connected at the other end to its respective supporting means; and in which at least one crank of each pair has said one end mounted to said fixed part via an eccentric mounting whereby the effective arc length of the crank can be varied in a stepless manner.

2. Apparatus according to claim 1, in which means are provided for adjusting all the eccentric mountings for each folder blade simultaneously.

3. Apparatus according to claim 2, in which each folder blade has associated therewith a shaft extending parallel to the folder blade, the shaft being mounted for rotation in bearings secured to said fixed part; and each eccentric mounting comprises an eccentric bush rotatable with the shaft and presenting a cylindrical outer surface which is eccentric with respect to the shaft, said crank being secured to a ring member in bearing engagement with said eccentric bush out surface.

4. Apparatus according to claim 3, in which a cylindrical bearing bush is interposed between the ring member and said eccentric bush outer surface.

5. Apparatus according to claim 3, including means for adjusting the rotational position of said shaft.

6. Apparatus according to claim 5, said shaft adjusting means comprising a handwheel driving said shaft via reduction gearing.

7. Apparatus according to claim 6, in which said reduction gearing comprises a worm drive gearbox.

* * * * *